US007604333B2

(12) United States Patent
Horsnell et al.

(10) Patent No.: US 7,604,333 B2
(45) Date of Patent: Oct. 20, 2009

(54) SYSTEM AND METHOD FOR PROVIDING IMAGE FORMING COMPOSITION ON A SUBSTRATE USING A DROP ON DEMAND INK PRINTER

(75) Inventors: David Andrew Horsnell, Cambridge (GB); Matthew Brian Tomlin, Cambridge (GB); Ammar Lecheheb, Cambridge (GB); Oliver John Prime, Cambridge (GB); Michael James Fox, Rutland (GB); Christopher Michael Bates, Northanta (GB)

(73) Assignee: Willett International Limited (GB)

( * ) Notice: Subject to any disclaimer, the term of this patent is extended or adjusted under 35 U.S.C. 154(b) by 113 days.

(21) Appl. No.: 10/550,807

(22) PCT Filed: Mar. 25, 2004

(86) PCT No.: PCT/GB2004/001377

§ 371 (c)(1),
(2), (4) Date: Jun. 15, 2006

(87) PCT Pub. No.: WO2004/085738

PCT Pub. Date: Oct. 7, 2004

(65) Prior Publication Data

US 2006/0238587 A1 Oct. 26, 2006

(30) Foreign Application Priority Data

Mar. 25, 2003 (GB) ..... 0306788.1

(51) Int. Cl.
*B41J 2/04* (2006.01)

(52) U.S. Cl. ..... 347/85; 347/44; 347/47; 347/54; 347/55

(58) Field of Classification Search ..... 347/100, 347/47, 55, 54, 85, 44
See application file for complete search history.

(56) References Cited

U.S. PATENT DOCUMENTS

| | | | | |
|---|---|---|---|---|
| 5,724,080 | A * | 3/1998 | Ikado | 347/85 |
| 7,331,654 | B2 * | 2/2008 | Horsnell et al. | 347/54 |
| 2001/0055053 | A1 * | 12/2001 | Kataoka et al. | 347/92 |
| 2005/0231553 | A1 * | 10/2005 | Horsnell et al. | 347/47 |
| 2006/0098060 | A1 * | 5/2006 | Horsnell et al. | 347/85 |

FOREIGN PATENT DOCUMENTS

| | | | |
|---|---|---|---|
| EP | 109242 | A * | 5/1984 |
| EP | 109242 | A2 * | 5/1984 |
| WO | 9408794 | | 4/1994 |
| WO | WO 9408794 | A1 * | 4/1994 |
| WO | 03033951 | | 4/2003 |
| WO | WO 03069201 | A1 * | 8/2003 |

OTHER PUBLICATIONS

International Search Report for PCT/GB2004/001377 mailed Feb. 4, 2005.

* cited by examiner

*Primary Examiner*—Manish S Shah
*Assistant Examiner*—Laura E Martin
(74) *Attorney, Agent, or Firm*—Joseph A. Yosick

(57) ABSTRACT

A method of printing onto one or more sides of a mesh fabric, such a polyester mesh typically used for flags and banners, using a drop on demand ink printer, wherein the printer is operated at a fluid pressure of between 1 and 3.5 bar and that the image forming composition has a viscosity of less than 100 cp.

6 Claims, 4 Drawing Sheets

SYSTEM AND METHOD FOR PROVIDING IMAGE FORMING COMPOSITION ON A SUBSTRATE USING A DROP ON DEMAND INK PRINTER

The present invention relates to a method, notably to a method for printing images onto fibrous materials.

BACKGROUND TO THE INVENTION

Many fabrics, both woven, looped and non-woven, have a surface which presents free ends of fibres generally normal to the plane of the fabric. Such fabrics include felted materials where fibres in a randomly orientated mass are compressed, optionally in the presence of a bonding agent such as an adhesive; materials woven from strands made up from a plurality of individual fibres where the surface of the fabric has been, brushed, teased, abraded or otherwise treated to separate some of the fibres from within the strands to form a fluffy surface to the material, for example a brushed nylon; woven materials made from materials which are inherently fluffy, such as knitted or woven angora, merino or cashmere wools or cotton terry towelling; and carpet type materials such as velvets, velours and tufted carpets where individual lengths of strands or fibres are knotted, sewn, glued or otherwise secured to a sheet member, typically a reticulate backing sheet, whereby the free ends of the strands or fibres form a pile which extends generally normal to the plane of the backing or where loops of the strands or fibres are formed extending generally normal to the plane of the backing and the free ends of the loops may be severed to form the pile. For convenience the term pile fabric will be used herein to denote all such types of material where individual fibres or strands comprising groups of fibres extend generally normal to the plane of the material to provide a pile effect surface to the material.

It is often desired to form patterns or images upon the surfaces of pile fabrics, for example a coloured pattern. This can be achieved by interweaving different coloured, textured or other material strands of wool or other material into the fabric as it is being made. However, this is difficult and time consuming, especially where the pattern is complex and/or a plurality of colours or textures are desired. Such use of a plurality of different strands is becoming progressively uneconomic in the large scale manufacture of commodity materials, such as patterned carpets.

It has therefore been proposed to manufacture the pile fabric from neutral or uniformly coloured fibres or strands and to apply a colour to the pile fibres after the fabric has been woven or otherwise manufactured. The colour is typically an ink applied by any suitable printing technique. A printing technique which is used is an ink jet printing technique using a drop on demand type of printer in which ink is ejected through a collection of nozzles each attached to a valve mechanism serving each nozzle. The opening and shutting of the valves is under the control of a suitable computer so that the valves are operated for the required duration and in the required sequence to produce the desired printed pattern on the fabric. However, problems arise in securing even application of the printing ink to the individual strands or fibres of the pile. The ink is desirably applied to carpets at the rate of about 300 to 400% by weight of the fibre to be coloured and needs to penetrate substantially uniformly throughout the strands formed from the individual fibres. If a very mobile ink having a viscosity of about 10 cPs at 25° C. (as is commonly used in an ink jet printer) is used, it will run down the length of the strands and form an intense coloration at the base of the pile, leaving the top portion of the pile inadequately dyed, and little penetration of the colour into the strands will take place. It is therefore necessary to increase the viscosity of the ink in order to ensure that it runs down the fibre at a sufficiently slow rate for uniform penetration of the ink into the strands and coverage of the surface of the individual fibres takes place. The longer the pile, the greater this problem becomes and with long pile fabrics, that is those with a pile length of about 2 mms or more, it is necessary to use a very viscous ink having a viscosity of from up to 500 cPs at 25° C.

Such viscous inks are difficult to jet through the very fine orifice nozzles, typically less than 500 micrometer diameter, and pressures far in access of those for which a valve ink jet printer is normally designed would be required. Furthermore, if a low viscosity ink were applied at such high pressures, it may issue from the nozzles as high powered jets and cause the individual strands to bend over and thus prevent the ink from contacting other strands in the pile. It is therefore customary to use nozzles having orifices which are progressively greater in diameter as the length and closeness of the pile increases. Thus, for a loosely packed pile in a Terry towel fabric, it may be possible to achieve satisfactory printing using inks with a viscosity of 6 to 15 cPs and a pressure of 1.5 to 2 bar through a nozzle of 60 micrometers diameter. However, with a heavier upholstery type of fabric which typically has a pile length of typically 3 to 5 mms, it may be necessary to use an ink with a viscosity of about 120 cPs, a pressure of 1.5 to 2.5 bar and nozzle diameters of 90 to 150 micrometers. With a carpet having a pile length of 15 mm or more it is necessary to use an ink having a viscosity of up to 500 micrometers, a pressure of about 2 bar and nozzle diameters of typically 500 micrometers in diameter so that the viscous ink can be ejected in sufficient amounts to attain the desired loading of ink on the individual strands.

Whilst the use of large diameter nozzles for high viscosity inks enables the ink to be deposited on the strands of the pile to achieve substantially uniform coloration of the individual strands and fibres, the size of the droplets issuing from the nozzle are sufficiently large to cause perceptible loss of definition in the printed pattern. Furthermore, the size of the droplets can result in adjacent droplets applied to the pile contacting one another to cause colour bleeding where the droplets are of different colours.

We have determined that the use of a drop on demand print head which operates at frequencies greater than 1 kHz enables the size of the droplets being printed to be reduced, which reduces the problems of colour bleed and enhances the definition of the printed image or pattern without reducing the print rate below commercially practical levels. Furthermore, we have found that it becomes possible to omit individual printed droplets from the printed pattern and thus print a blank within the image which is not visually perceptible but which acts to provide a gap within the printed strands to act as a barrier to colour bleeding. Such a gap may also be printed as a black line defining the edges of areas printed with different colours, which enhances the perceived definition of the printed image or pattern.

It has also been discovered that drop-on-demand ink jet printers are also suitable for printing applications in which colour needs to be applied to a thin fabric, such as, for example, a polyester mesh, with the result that the colour on each side of the fabric is of equal brilliance. Such an effect is a requirement when printing flags and banners, for example. Most known ink jet printing machines used to print onto light textiles tend to utilize impulse jet printing technology that, whilst producing high definition printing, lays down very small amounts of ink in a dotting fashion. This tends to result in pale colours being printed unless multiple print passes are used which significantly slows down the linear print rate. The other disadvantages associated with impulse jet printing technologies include the low pressures at which impulse jet printers operate and the low viscosity inks that must be used with the printers. This is a particular disadvantage for textile printing as higher viscosity inks are preferred as they provide a more consistent depth of colour pick up through the textile, which is vital to obtaining quality print. Higher viscosity fluids also prevent sideways wicking ("bleeding") of fluid, thus avoiding poor colour definition and/or unintended colour "blending" at colour change points in the printed pattern.

In order to obtain bright colour quality and achieve a consistent depth of colour through the textile pile at high print speeds, it is preferred to have the option to apply the ink by opening the printing nozzle orifice and keep it open for a period of time sufficient to form a stripe of a desired length. This technique is referred to as dosing. This process is different to producing a multiplicity of dots in a linear print fashion and ensures continuous, consistent colour dosage through the textile fibres.

It has been found that a drop on demand print head, in which individual valves are mounted and fed from a common, chamber via a plug in system can be arranged to produce both dot and dosing print effects. An important feature of this arrangement is that it can use high viscosity inks. A further advantage of the arrangement is that the design of the drop on demand head enables fluid pressures of up to 3.5 bar to be used. Impulse jet heads do not have the capability for higher viscosity inks or high pressure application. A further advantage of individually plug in mounted and supplied valves is the significant reduction in space needed to present requisite number of print orifices, thereby enabling higher definition dot printing. The provision of individual valves which can be fitted in this manner also enables fast and economical valve replacement for maintenance purposes as the plug in facility provided for fast and accurate fluid and electrical connection. The combination of higher viscosity inks (for example 12 cp or greater) and high pressure application enables the provision of a printing capability that can not be achieved using other known technology.

A further advantageous feature of the drop on demand arrangement is the ability to pass higher viscosity fluids through the arrangement without incurring flow problems and pressure drops across a bank of nozzle orifices. This is achieved through a combination of methods of fluid feed and internal channel design. This feature mitigates the effect referred to as 'banding', in which a striping effect can be seen on the printed textile surface if pressure drops occur at the nozzle orifices, particularly when the print head is dosing. A significant additional benefit of operating in a dosing mode is the reduction in mechanical wear of the moving parts of the valve due to less open and close operations than would otherwise be required in a rapid dotting mode. A further advantage is the relative ease in which constant pressure can be maintained across all adjacent orifices.

The drop on demand arrangement can be configured such that multiple modules (for single or multiple colour printing) can be mechanically arranged to provide larger area of print coverage with precise alignment of the nozzle orifices. In this way, for example, a bank of modules can be arranged to provide wide coverage for individual colours, whilst physically aligned with further banks of modules for other colours. An important design feature is that modules can easily be mounted to achieve a "seamless" bank of nozzle orifices with accurate pitching of adjacent modules relative to each other. Furthermore, these banks of modules can also be manifold fed with ink such that one bank of modules can be dedicated to one colour. Each bank of modules is attached to a mechanical mounting system that can be arranged so that individual modules can be replaced without disturbing the ink supply tubing or drive electronics, enabling the simple maintenance and/or replacement of modules.

It should also be noted that when printing in a dosing mode it is still necessary to provide very accurate control of the valve such that the line produced by the dosing sequence has a sharply defined cut off at its start and end points. Such fine control is achieved with this invention.

The design of the printer module is such that the main nozzle chamber can be heated or cooled with accurate temperature control. The benefit of this feature is that the jetting viscosity of some textile ink types can be modified at the point of jetting to achieve best jetting performance whilst retaining best colour penetration performance on the textile substrate. Typically this would be the case where a high viscosity ink is required for colour penetration needs and the jetting of the ink is best performed through reducing the viscosity through heat application. Alternatively, a cooling mode could be used where excess heat in the system can be controlled to ensure the jetting viscosity is not too low to ensure best colour penetration on the substrate.

SUMMARY OF THE INVENTION

Accordingly, the present invention provides a method for applying an image forming composition to one or more sides of a mesh fabric using a drop on demand ink printer, characterised in that the printer is operated at a fluid pressure of between 1 and 3.5 bar. Preferably the image forming composition has a viscosity of less than 100 cp and further preferably the image forming composition viscosity is in the range of 5 to 20 cp. The use of a pressurised fluid provides significant advantage in textile printing when compared with the more commonly utilised in impulse jet systems. Variable positive pressure provides the ability to jet higher viscosity inks such as that typically used in textile printing and prevents nozzle depriming problems often suffered by impulse jet products.

A particularly preferred drop on demand ink jet printer is one having an array of nozzles in which a solenoid valve controls the flow of an ink through the individual nozzle orifices and the nozzle orifices have a diameter of from 20 to 200 μm, notably about 40 to 60 μm for thin mesh fabric types. and in which the plunger of the solenoid valve has a diameter of less than 2.5 mms. Such valves can be constructed so as to be compact and thus capable of printing closely separated dots and in which the formation of the drops at the nozzle orifices is accurately controlled, thus further enhancing the definition of the printed image. We have also found that the use of such a printer enables individual control of the printing of the dots of the image so that accurate over-printing of dots or dosing strips can be achieved, thus enhancing the colour range and strength which can be achieved. Such a printer thus enables an infinite scaling of the colour hues which can be achieved.

The invention can be applied to the application of any form of image to a fabric. However, the invention is of especial application in the application of a water and/or solvent based ink composition to form a patterned image on a fabric. In order to produce clearly defined and consistently sized droplets, or streams in the case of dosing, at the nozzle orifices of the printer and clearly defined start and stop actions in a dosing sequence, it is preferred to use a printer in which the solenoid valves mechanisms for controlling the flow of fluid to the nozzle orifice comprises a plunger member journalled for axial reciprocation between a rest and an operative position within an electric coil under the influence of a magnetic field generated by that coil when an electric current passes through the coil, the distal end of the plunger extending into a valve head chamber having an outlet nozzle bore, the reciprocation of the plunger being adapted to open or close a fluid flow path from the valve head chamber through that bore, characterised in that:

a. the plunger is of a unitary construction and is made from an electromagnetically soft material having a saturation flux density greater than 1.4 Tesla, preferably about 1.6 to 1.8 Tesla, a coercivity of less than 0.25 ampere per meter, and a relative magnetic permeability in excess of 10,000; and b. the nozzle bore leading from the valve head chamber to the nozzle orifice has a length to diameter ratio of less than 8:1, preferably from 1.5:1 to 5:1, notably from 2:1 to 4:1.

The term magnetically soft is used herein to denote that the material loses the magnetic field induced in it by the coil when the current in the coil ceases, in contrast to a permanent magnet which retains its magnetism. For convenience, the terms distal and proximal will be used herein to denote that portion of a component which is located downstream and upstream respectively with respect to the flow of ink or other fluid through the valve.

We have found that the use of the specified materials for the plunger overcomes many of the problems associated with the use of the conventional stainless steel plunger materials, for example Carpenter 430F, which have saturation flux densities of less than about 1.2 Tesla, coercivities of about 0.95 to 2 A/m and permeabilities of less than about 3,000. We have found that the conventional materials generate excessive heat energy when reciprocated at frequencies of 1 Khz or when held in a constant open state typical as used in dosing. The use of materials having high magnetic flux saturation densities enables the plunger to respond rapidly to changes in the magnetic field generated by the coil without the generation of excessive heat or to be held open for long periods at reduced power levels, necessary for dosing applications. The low coercivity of the plunger material also aids the rapid rise and fall of the induced magnetic field within the plunger under the influence of the field generated as a current is passed through the coil at low applied coil currents. This, coupled with the high permeability of the material, enables a high magnetic drive force to be generated rapidly between the coil and the plunger. As a result, the plunger can be accelerated rapidly by the coil without the need to apply high drive currents to the coil, typically in excess of 20 amperes, as hitherto considered necessary. This again reduces the heat energy which is generated as the plunger is moved by the coil. The low coercivity also permits a reverse magnetic force to be generated rapidly by reversing the direction of the current in the coil. This reversed force can be used to slow down the movement of the plunger as it reaches either or both extremes of its travel. Such magnetic braking may be used in place of or in conjunction with the bias spring conventionally used to return the plunger to its rest position. The magnetic braking can also be used to reduce the impact of the plunger as its seats against the inlet to the nozzle bore or held, open as required for dosing. This not only increases the operating life of the plunger and seal components, but also reduces satellite droplet formation as the valve closes. However, it will usually be preferred that the valve mechanism of the invention also comprises a pre-tensioned spring member to bias the plunger against the magnetic field generated by the coil so as to return the plunger to its rest position when an electric current is not applied to the coil.

Furthermore, we have found that the above design of valve can be held in the open position for prolonged periods to print continuous lines on the substrate (dosing). In practice this often leads to the valves burning out due to the high currents applied to the coil to move the plunger from its initial rest position into the valve fully open position. We have found that the amplitude of the current flowing through the coil required to hold the plunger in the valve open position is surprisingly much less, typically 80 to 50% less, than the current required to move the plunger initially away from its rest position. By applying a current pulse which has an initial amplitude sufficient to move the plunger from its rest position to the valve open position and then reducing this amplitude to a lower value for the remainder of the pulse, it is possible to hold the valve open for prolonged periods so as to print lines of ink on the substrate. This is essential for best quality textile printing where a dosing action is used.

We have found that these benefits are achieved to a remarkable extent when the plunger is of low mass, for example when the plunger has a diameter of less than 2.5 mms, notably about 1 mm, and has a length to diameter ratio of more than 3:1, preferably from about 5:1 to 10:1. As result, in a preferred embodiment, the invention provides a compact, light weight solenoid valve characterised in that the plunger has a diameter of less than 2.5 mms, notably about 1 mm, and has a length to diameter ratio of more than 3:1, preferably from about 5:1 to 10:1. Preferably, the plunger has a unitary construction and is made from a material having the magnetic properties defined above.

Surprisingly, we have further found that where the above type of valve is used in a drop on demand ink jet printer, problems due to drying out of the ink within the nozzle bore are reduced. In ink jet printers, drying out of the ink through loss of the solvent or carrier medium for the ink when the printer or nozzle is at rest and ink is not flowing through the nozzle bore, causes the formation of solid deposits in the bore. In a conventional drop on demand or impulse jet printer, when the valve or transducer of the print head is actuated again to eject a droplet from the nozzle orifice after such a rest period, this deposit impedes the flow of ink through the nozzle bore. As a result, the initial droplets ejected from the nozzle orifice are deformed and of uneven size. Surprisingly, we have found that, despite having a lower length to diameter ratio of the nozzle bore as compared to a drop on demand printer, the above design of valve recovers more rapidly than a conventional drop on demand ink jet printer valve after a rest period. As a result, problems due to initial droplet malformation after a rest period of the valve are reduced.

Surprisingly, we have found that by reducing the length to diameter ratio of the nozzle bore to less than 8:1, notably less than about 5:1, and, as viscosity increases, notably less than 2:1, distortions of the shape and size of droplets produced at the nozzle orifice can be reduced using the above design of valve. Furthermore, by reducing the length of the nozzle bore, the pressure drop across the nozzle is reduced, allowing a faster exit velocity to be achieved at the nozzle orifice. Surprisingly this is achieved without causing spraying of the droplets, that is the break up of the droplet at the nozzle orifice into a plurality of smaller droplets. This enables a higher frequency of droplet generation to be achieved at a given ink pressure for a given length of flight path and still enables a unidirectional jet to flow for dosing.

In a preferred embodiment of the invention, the valve is used with a nozzle plate having a plurality of nozzle bores which are formed substantially simultaneously in a single operation so that the nozzle plate has a unitary construction without the use of jewel nozzles. Such a simple unitary nozzle structure can readily be made using a wide range of techniques and overcomes the problems associated with misalignment of jewel nozzles in a multi-nozzle print head.

As indicated above the plunger is of unitary construction and is made from a material having the specified properties. The plunger is preferably made from an alloy of iron and nickel, typically containing 40 to 55% of nickel, preferably an alloy containing from 45 to 50% nickel and 55 to 50% of iron. If desired, other metals, for example chromium or aluminium, may also be present in minor amounts. Preferred materials for present use are those which have a saturation flux density in excess of 1.6 Tesla, for example 1.8 Tesla of more. The coercivity is less than 0.5 amperes per meter, notably less than 0.25 a/m. The permeability is preferably in excess of 50,000, for example 100,000 or more. Suitable materials for present use include those ranges of alloys sold under the Trade Names Permenorm 5000 and Vacofer SI.

The plunger may be formed wholly from such materials, for example by drawing or machining a cylindrical or other shaped plunger from the solid material using any appropriate technique. Alternatively, the plunger may be formed from a fritted, pressed or cast polymeric or ceramic carrier having particles of a suitable ferromagnetic material or mixture of materials dispersed therein. In a further alternative, the material from which the plunger is formed may be a laminate of different forms of ferromagnetic material to give a composite structure having the required overall properties. For convenience, the invention will be described hereinafter in terms of a unitary plunger formed from a solid body of a single Ni/Fe alloy.

The plunger is conveniently formed by machining, rolling or extruding the desired alloy to form a length of material having the desired size and shape. As indicated above, it is particularly preferred to form the plunger as a generally cylindrical member having a diameter of less than 2.5 mms and a length to diameter ratio of more than 3:1, preferably 5:1 to 10:1, since such a plunger can be used to provide a compact construction for the valve.

Where the plunger has a diameter greater than about 2.5 mms, part of the core of the plunger can be removed to form an internal bore within the plunger extending from the distal end of the plunger. This reduces the mass of the plunger. Surprisingly, this does not affect the magnetic properties of the plunger to a significant extent and the plunger behaves magnetically as if it were a solid member. For example, an axial bore can be formed as a blind ended drilling from the distal end in a solid rod of a suitable material. Preferably, the bore does not extend axially into that portion of the plunger housed within the coil when the plunger is fully retracted into the coil so that that portion of the plunger within the coil is solid. This maximises the magnetic force which acts upon the plunger during initial extension of the plunger from the coil when the coil is energised.

During the machining of the preferred materials of construction to form the plunger for the valve, the magnetic properties of the material may be affected. It may therefore be desired to subject the manufactured plunger to some form of post forming treatment so as to recover the magnetic values. Such treatments include heat treatment or mechanical impact treatment which cause a change in the crystal composition of the material. The optimum form of post forming treatment can be readily determined using simple trial and error.

The plunger will typically have a circular cross section and be a sliding fit within the cylindrical bore which extends axially within the coil so that it can be reciprocated smoothly within the coil. However, it is within the scope of the present invention for the plunger to have a polygonal or other non-circular cross section and/or for the bore in the coil to be non-circular, so as to provide axial fluid flow passages between the plunger and the coil. This will allow fluid to be displaced from the proximal end of the coil bore as the plunger is retracted into the coil and thus reduce fluid damping of the movement of the plunger. Alternatively, or in addition, these passages may be used to feed fluid from an inlet at the proximal end of the valve assembly to the valve head chamber at the distal end of the coil. For example, the plunger can be formed with two or more axial flats which co-operate with the walls of a cylindrical coil bore to allow fluid to flow past the plunger. Such fluid flow may also serve to cool the plunger and coil during operation of the valve.

As stated above, the nozzle bore between the valve head chamber and the nozzle orifice differs from that used in either a conventional drop on demand print head or an impulse jet print head in that the length to diameter ratio of the bore is typically less than 5:1 as compared to the 10:1 and greater ratio used in a conventional drop on demand print head and is greater than about 1.5:1 as compared to the less than 0.5:1 ratio used in an impulse jet head. We prefer that the length to diameter ratio be from 2.0:1 to 5:1, notably 2:1 to 4:1. It has also been found that for the higher viscosity inks used to print on thinner materials a ratio of greater than 1:1 is applicable.

We have found that the amount of fluid remaining in the bore to the nozzle orifice of the above design of valve after the ejection of a droplet from the nozzle orifice is usually smaller than can be achieved with a conventional drop on demand print head. This is particularly the case where the length to diameter ratio of the nozzle bore has the effect of achieving a nozzle bore volume which is approximately equivalent to the volume of ink which is to be ejected at each actuation of the valve. As a result, the damping effect of the inertia of this fluid on the movement of the plunger of the valve is reduced, further assisting rapid movement of the plunger under the influence of the coil thus assisting high frequency operation of the valve.

In a preferred embodiment of the drop on demand print head for present use, the nozzle orifice and bore through which the ink is ejected upon operation of the valve are formed as a unitary structure, for example concurrently as a bore is cut or otherwise formed in a plate upon which the valve mechanism is to be mounted. For example, the bore/nozzle orifice is formed in a nozzle plate by a laser, electro-forming or etching, needle punching or other techniques. The nozzle plate can be from 50 to 400 micrometers thick so as to achieve the desired length to the bore. At such thickness, the nozzle plate takes the form of a metal or other foil which is mounted in a suitable support member to provide a rigid and mechanically strong nozzle plate assembly. We have found that by forming the nozzle bores simultaneously in a multi-nozzle nozzle plate, problems due to misalignment of the bores with one another are minimised.

We have also found that by selection of the bore forming technique, the walls of the bore are sufficiently smooth to reduce flow separation and the formation of eddies at the interface between the bore walls and the fluid flowing through the bore-this assists in the flow of higher viscosity fluids as required for textile printing. Furthermore, such techniques may also be used to form other features on the nozzle plate which enhance the operation of the valve. For example, electro-forming or etching of a metal foil can be used to form the bores/nozzle orifices in the plate and also to form a raised lip or ridge around the inlet to the bore leading to the nozzle orifice. This provides a localised pressure point between the distal end face of the plunger and the nozzle plate to assist the formation of a fluid tight seal when the plunger is in the valve closed position. Alternatively, where a needle is used to form the bore in a metal foil, this will cause the foil to deform and form a belled entry to the bore which will assist smooth flow of fluid into the bore from the valve head chamber. The penetration of the needle through the foil may also polish the surface of the foil, and hence the internal wall of the bore which is formed, as the surface of the needle slides over the material of the foil. Similarly, the use of a laser to form the bore in a metal, ceramic or plastic foil may also form a polished surface to the walls of the bore, notably where the laser beam is pulsed for very short periods, typically less than 1 nanosecond, to reduce the formation of deposits around the lip of the bore of material which has been ablated from the plate in forming the nozzle bore.

The solenoid valve mechanism for present use a coil through which an electric current is passed to generate the magnetic field which acts upon the plunger. In conventional designs of solenoid valve, such a coil is wound upon a bobbin, for example of a suitable insulating plastic. The bobbin is then located upon a tubular member which forms the support for the bobbin and provides the walls of the axial bore within which the plunger reciprocates. We have found that it is desirable to minimise the radial air gap between the conductor of the coil and the plunger so as to optimise the magnetic coupling between the coil and the plunger. This can be achieved by winding the conductor of the coil directly upon the tubular member within which the plunger reciprocates, with a thin insulating interface between the wire of the coil and the tubular member where a metal tube is used. Alternatively, the coil can be formed by winding a bare wire coil upon an insulating tubular member and then retaining the coil in position by applying a retaining coat of resin or other binder upon the wound coil. Alternatively, the coil can be wound upon a mandrel or other former, removed from the former and then potted in a suitable resin which forms the wall of the tubular member within which the plunger reciprocates. In a particularly preferred embodiment, the tubular member is formed from a ceramic material, for example as a ceramic frit tube or electro-etched silicon tube. The coil can be formed by depositing a conductor track, for example by vapour phase or electrical deposition of a copper, gold or silver conductor or track, upon the surface of the tube or into grooves etched, machined, laser cut or otherwise formed in the external surface of the tube. Alternatively, the coil may be formed as a copper, silver, gold or other conductive track upon a flexible circuit board which is then rolled upon a mandrel to form a cylindrical tubular member incorporating the coil.

In all such designs of the coils for present use, the radial air gap between the conductor of the coil, including the sliding clearance between the plunger and the wall of the bore in the tubular support for the coil conductor and the thickness of that support, has been reduced, typically to a radial dimension of less than 0.5 mm, for example 100 to 200 micrometers. This is compared to the 1 mm or greater air gap in a conventional solenoid coil. Such a reduction in the air gap results in greater efficiency in coupling the plunger magnetically to the coil, resulting in lower power consumption and greater speed of response of the plunger to changes in the current flowing in the coil. Such constructions also result in a unitary construction for the coil and the tubular member within which the plunger reciprocates, thus simplifying construction and assembly of the valve. the embodiment of a small radial gap also assists in avoiding large amounts of "trapped" ink when flushing out the print module. this is particularly important in avoiding colour "carry over" when changing colours in the system. for example when changing from say a black fluid to a yellow fluid where no carry over of black fluid is important.

As indicated above, the solenoid valve also comprises a valve head chamber which houses the distal end of the plunger and is provided with the outlet nozzle bore to the nozzle orifice. Such a chamber typically is of generally circular cross section and has a transverse end closure wall having the outlet and the nozzle bore to the nozzle orifice formed therein. If desired, the tubular support member for the coil can be longitudinally extended to provide the radial walls of the valve head chamber. In one embodiment of such a construction, the tubular member is formed as a cylindrical tube having one end closed to form the transverse terminal wall of the valve head chamber, the wall being pierced by a bore whose free end provides the nozzle orifice. Such an assembly can readily be formed by electro or laser etching of a silicon or ceramic member to high accuracy using automated techniques.

The valve mechanism is preferably used in co-operation with a plurality of closely adjacent valve mechanisms, each serving one or more discrete nozzle orifices to form an array type print head capable of applying a plurality of dots of fluid to a substrate to create a two dimensional image on a substrate. Such an array can be formed by mounting the outlet end of the valves upon a nozzle plate with a bore through the plate providing the nozzle bore from the valve head chamber of the valve to the nozzle orifice. Preferably, the valves are located in staggered rows to achieve as close a spacing for the nozzle orifices in the nozzle plate. If desired, the nozzle bores from each valve head chamber can be at an angle to permit the valve bodies to be offset from the centre line of the nozzle plate to enable the nozzle orifices to be more closely spaced. In a particularly preferred embodiment, the nozzle plate is provided with a series of upstanding tubes, each in register with one of the bores through the plate. The tubes serve as the support for the coil of the valve and the plunger reciprocates within that tube. The distal end portions of the tubes adjacent the nozzle plate, or the proximal portion of the bore in the nozzle plate, serves as the valve head chamber of the valve mechanism. Such arrays can be formed from ceramic or silicon materials using automated techniques and the nozzle orifice can be provided either by a jewel nozzle set into the distal end of the bore through the nozzle plate or by forming a suitable nozzle orifice in the end of a blind end bore in the nozzle plate as described above. Such assemblies can be formed on a very small scale enabling miniaturisation of the valve structure to be achieved. It is preferred to provide the nozzle plate as a metal, ceramic or other foil having the bores formed therethrough as described above and to mount that plate so that the bores therein are in register with the distal ends of the plungers of the valves. In this case, the valve head chambers can be individually formed in the surface of the foil or in an intermediate plate located between the valve coil support members and the nozzle plate. However, we have found that the flow of ink or other fluid to the individual bores and nozzle orifices is enhanced if the intermediate plate is formed with a continuous chamber which provides a combined valve head chamber for all the valves in the print head assembly. such construction is essential to achieve accurate balanced fluid flow across the nozzles. In such a construction, the seal between the distal end face of each plunger and the registering bore in the nozzle plate provides adequate isolation of flow through each of the nozzle bores and orifices. The opposing faces of the nozzle plate and the distal end of the plungers are preferably provided with sealing means to assist the formation of a fluid tight seal when each plunger is in the closed position. For example, the end face of the plunger can be provided with a natural or synthetic rubber or polymer face which deforms to provide a seal against the opposed face of the nozzle plate. The face of the nozzle plate can be provided with one or more annular raised ribs or the like which provide localised raised pressure areas to assist formation of the fluid tight seal. Such raised areas can readily be formed on the face of the nozzle plate during the electro-forming or etching of the nozzle plate.

If desired the raised areas on the nozzle plate can be formed from a flexible material to cushion the impact of the end face of the plunger against the nozzle plate. Such deformation may also assist formation of the fluid tight seal where the end face of the plunger does not carry a rubber or similar pad. If desired, the pad carried by the end face of the plunger can be formed from a material which undergoes cold creep or deformation under the load of the bias spring urging the plunger into the valve closed position. Such creep may form a nipple or other projection which extends into the proximal portion of the nozzle bore in the nozzle plate. Upon reciprocation of the plunger, this projection repeatedly wipes at least the initial part of the proximal portion of the nozzle bore and displaces solid deposits which may have deposited upon the wall of the bore and this may assist in reducing initial drop deformation after rest periods of the valve. To assist the operation of this projection, the mouth to the inlet to the bore through the nozzle plate may be belled, as may occur when a needle is used to form the bore in the nozzle plate.

Where the valves are mounted in close proximity with one another to form a print head containing a plurality of nozzle orifices, it is preferred to provide each valve mechanism with a metal housing to the coil thereof which acts not only as a return path for the magnetic field generated by the coil within it, but also acts as a magnetic screen so as to reduce cross talk between the magnetic fields generated by one coil and the coil of an adjacent valve mechanism. Typically, such a metal housing is made from μ-metal, aluminium or stainless steel and also acts as a rigid housing for the components of the valve mechanism. Thus, the housing can be of a generally cylindrical form and can be crimped radially inwardly at each end thereof to retain the coil assembly. The distal end of the metal housing can be crimped or otherwise secured to the nozzle plate where the nozzle plate carries upstanding tubular members as described above.

As stated above, the valve mechanism preferably also comprises a spring member to provide the bias to return the plunger to its rest position when a current is not applied to the coil. Typically, the spring is a compression spring and acts to bias the plunger against the inlet at the proximal end of the bore to the nozzle orifice, so that the rest position of the plunger is in the valve closed position. When a current is applied to the coil, this opposes the bias of the spring and moves the distal end of the plunger away from the bore inlet to open a flow path from the valve head chamber to the nozzle orifice. However, it will be appreciated that the rest position may be the valve open position and the operative position is the valve closed position. For convenience, the invention will be described hereinafter in terms of the rest position being the valve closed position.

The spring member is pre-tensioned, for example from 50 to 80% of the travel of the compression of the spring is taken up by the pre-tensioning, since we have found that such pre-tensioning enables the spring to apply a consistent bias force against the movement of the plunger over the remainder of the compression of the spring during movement of the plunger. We have found that the use of a conical spring is of especial benefit since such springs can readily be fitted within the dimensions of the valve head chamber and will tend to be self centring during the assembly of the valve mechanism, whereas conventional cylindrical coil springs do not. Furthermore, the use of a conical spring reduces the mass and hence inertia of the spring, further aiding rapid response of the spring to movement of the plunger. It is particularly preferred to use a conical coil spring which is pre-tensioned to the last two turns of the spring, since we have found that such a spring responds rapidly to the movement of the plunger and the pre-tensioning enables the spring to exert a significant bias force over a small additional compression of the spring.

Fluid can be fed to the valve head chamber by any suitable means, for example by one or more radial inlet ports in the side wall of the chamber. Alternatively, as described above, the plunger and/or the internal wall of the tubular support for the coil can be formed with axial flats or passages so that fluid flows axially past part or all of the plunger within the coil so that the fluid lubricates the movement of the plunger within the coil and can also act to cool the coil at high current loadings and/or high frequencies of operation of the valve. Where the valve mechanism is used as party of an array print head having a plurality of nozzles, it will usually be preferred to feed at least part of the ink or other fluid by means of a manifold plate in which inter-connecting valve head chambers are formed so that ink may flow freely along an elongated chamber to aid uniform flow to each nozzle bore in the associated nozzle plate as described above. this type of arrangement is critical for the success of jetting higher viscosity textile inks for example.

In the method of the invention, the printer can be operated in the conventional manner using a computer programmed to select the sequence and duration of operation of the valves in the print head. However, we prefer to utilise the computer to achieve other controls of the operation of the valve mechanism so as to compensate for fluctuations in the ink and/or operating conditions of the printer. Thus, for example, a CCD camera or array and computer can be used to inspect the droplet at the nozzle orifice and/or the printed dot and to modify the current applied to the coil of the valve during printing of images so as to optimise the image being printed. Thus, the computer can be programmed to decelerate the movement of the plunger at either or both extremes of its travel. We have found that this reduces splatter of the ink from the nozzle orifice due to sharp impact of the plunger against the seal members at the entry of the bore between the valve head chamber to the nozzle orifice. As indicated above, this may also reduce wear on the sealing components of the nozzle plate and the end face of the plunger. The software controlling the operation of the valve mechanism can be used to compensate for fluctuations in the viscosity of the ink due to temperature variations or other reasons; variations in voltage applied to the different coils in an array of print heads which are operated simultaneously; and to compensate for other changes in operating conditions, for example the use of a different ink, which require changes in the form and size of the electrical pulse applied to the coil of the valve. The use of software can also be used to hold a valve in the open position to print a continuous line of ink, as with the dosing action, in place of the series of overlapping dots achieved with present print head operating techniques. As stated above, this enables a lower current to be passed through the coil during the hold open status after the initial larger current has be applied to open the valve. If desired, the open time of the valve can be increased to compensate for the reduction in size of the initial droplets ejected from the nozzle orifice following a rest period of the valve.

Such a combination enables the printed droplet and/or dot quality (for convenience hereinafter referred to solely as the dot quality) to be monitored and corrected on-line during operation of the printer. Hitherto, the print quality was observed objectively by the operator of the printer and a correction to the operation of the printer applied manually. The ability to use the software on-line to achieve monitoring and correction of print quality is a major benefit to the operator and can achieve virtually instantaneous correction of fluctuations in print quality.

The monitoring and correction may be achieved using conventional software and hardware techniques and designs. The dot quality can be monitored continuously and a correction applied in response to the average of three or more successive dots. Alternatively, the printed dot quality can be monitored at intervals, for example every second or at intervals of every twenty operations of the valve, and any correction applied once the printed dot deviates by more than say 5% in any one or more of the parameters used to assess the quality of the printed dot.

Typically, the monitoring of the printed dot quality will be used to apply a signal to vary the open time of the valve. The software may also be used to operate the valves forming a printed raster alternatively rather than in strict sequence. Thus, the software can operate valves 1, 3, 5 and 7 simultaneously, and then valves 2, 4, 6 and 8 to achieve overlap of the printed dots by suitable time delay and thus achieve better definition in the printed image. this feature has particular significance with regard to textile printing where the individual control of nozzle jetting coupled with dot size control enables colour shading to be achieved on the substrate.

It will be appreciated that the signal indicating that some variation of the operation of the valve is required may be provided from an external source rather than from the on-line scanning of the printed dot. Thus, a sensor may monitor the operating temperature of the printer and/or of the ink fed to the valve, since this will affect the viscosity and hence the jet-ability of the ink. Such sensors may monitor the voltage applied to the valve mechanism, for example the voltage drop which occurs when a plurality of valves are operated simultaneously from a single power source, the time for which a specific valve has rested between printing operations, the frequency of operation of a valve and so on. These sensors may then address a series of look up tables which then set the variation of the open time required to reduce defects in quality of the printed dot if the parameter being monitored varies from a predetermined optimum value.

It is preferred that the quality of the printed dot from each nozzle be monitored individually. However, if desired the printed dot quality from groups of nozzles may be monitored collectively.

In the conventional computed control of the operation of a valve in a drop on demand printer, simple single bit signals are used to open and shut the valve since all that has been required hitherto is that the computer instruct the valve to open and shut so as to print a dot of the required size. However, the ability to vary the operation of each valve individually during the operation of the printer in response to many inter-related factors requires the transmission of more complex signals than simple open and shut instructions. We have found that it is desirable to transmit signals in byte format so that the amount of information transmitted can accommodate the permutations of operating parameters desired. Thus, for example, the use of byte form signal transmission offers 256 possible graduations of open time of the valve. This enables the amount of ink deposited in each printed dot to be varied over a very wide range by providing a look up table with 256 individual addresses therein from which the computer controlling the operation of the printer can instruct the open time of the valve to be selected. This enables a true graduation of colours in the image to be achieved. The use of byte signal transmission enables a wide selection of values for variation of a given operating parameter to be transmitted and responded to rapidly and accurately, further enhancing the speed and accuracy of operation of the print head.

DESCRIPTION OF THE DRAWINGS

A preferred form of drop on demand print head and its use in printing images under on-line software control will now be described by way of illustration only and with respect to the accompanying drawings, in which.

DESCRIPTION OF THE PREFERRED EMBODIMENT

Figure 1:
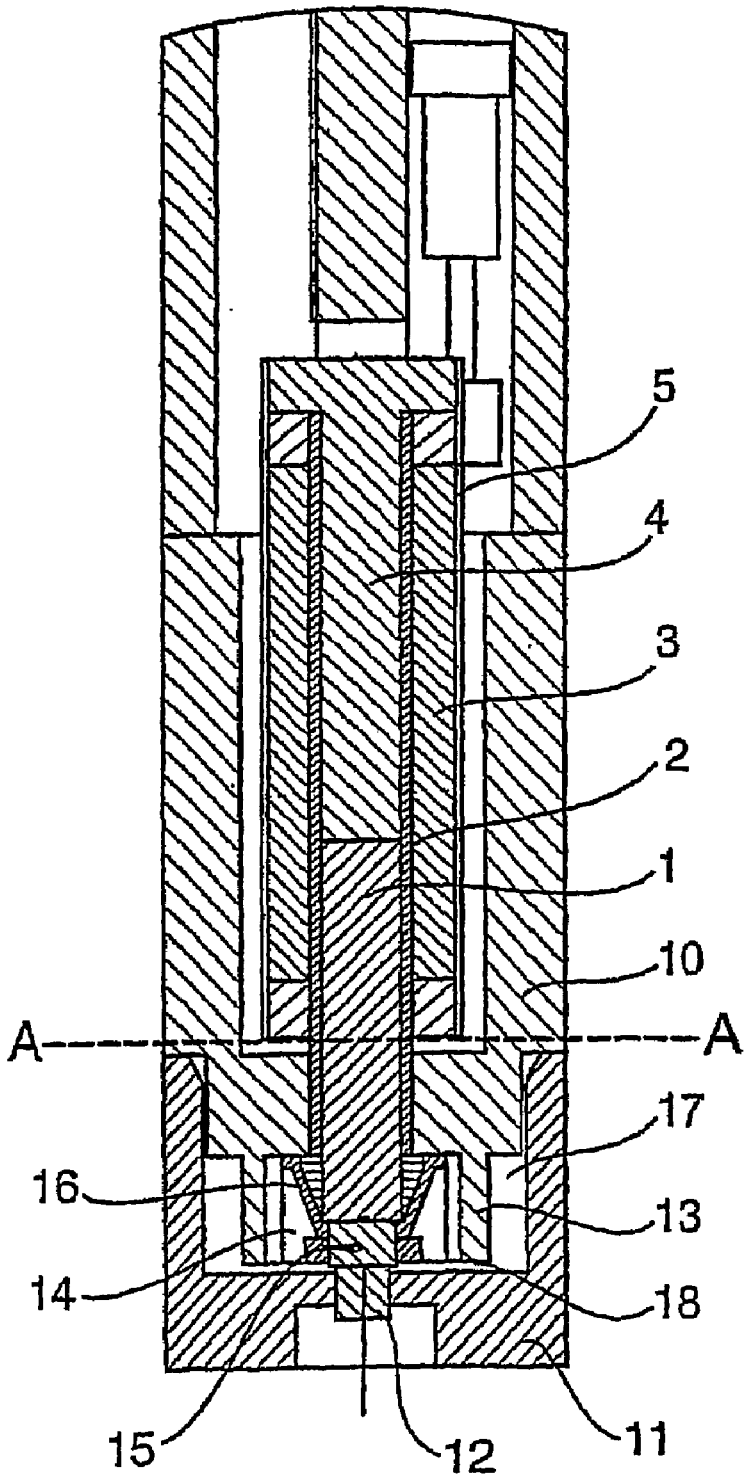
FIG. 1 is a diagrammatic axial cross section through a preferred design of valve for present use.
Figure 4:
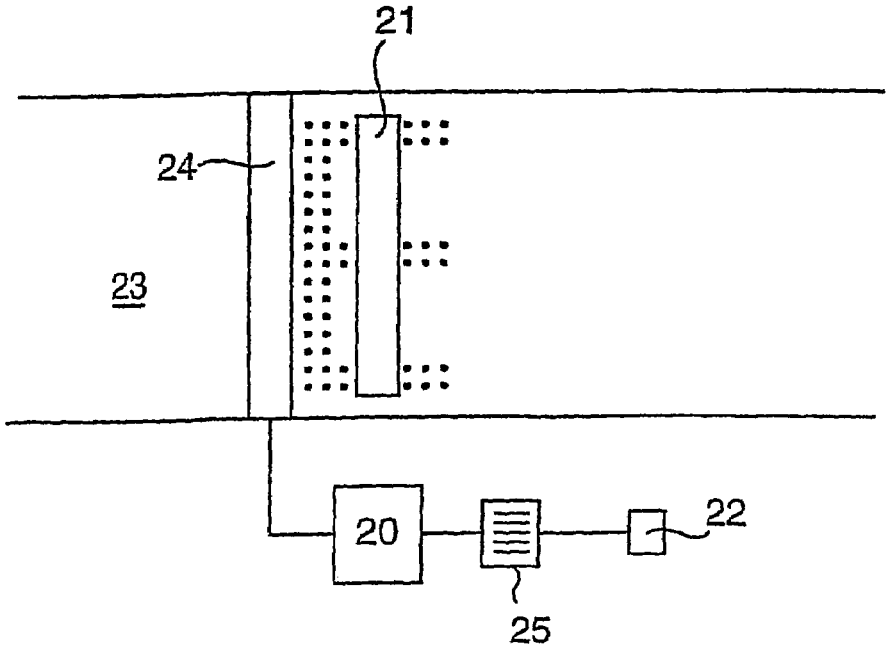
FIG. 4 is a diagrammatic block diagram of an array of FIG. 2 in combination with a CCD camera for monitoring the quality of the printed dots and a computer for establishing what variation to the frequency, form, shape and amplitude of the electrical pulse applied to the coil of the valve of FIG. 1 is required to compensate for any deviation in the quality of the observed printed dot.

The valve of FIG. 1 comprises a plunger 1 which is journalled as a close, free sliding fit for axial reciprocation in a stainless steel tube 2. Tube 2 has a thin insulating coating or sleeve (not shown) formed upon its outer face and supports a coil 3 wound upon it. Coil 3 is supplied with an electric current from a source (not shown) under the control of a computer 20, shown in FIG. 4. A stop 4 is mounted at the proximal end of tube 2 to limit the axial retraction of plunger 1 within tube 2. The coil 3 is encased in a metal cylindrical housing 5.

The above assembly is mounted in a support housing 10 which extends axially beyond the distal end of the coil and has a transverse end wall 11 which carries a jewel nozzle 12. In the embodiment shown in FIG. 1, housing 10 has an axially extending internal annular wall 13 which forms the radial wall of the valve head chamber 14 into which the distal end of the plunger extends. The distal end of the plunger 1 carries a terminal rubber or other sealing pad 15 which seats against the proximal end face of jewel 12 in sealing engagement. A pre-tensioned conical spring 16 biases plunger 1 into sealing engagement with the face of the jewel as shown in FIG. 1, the rest or valve closed position.

Plunger 1 is made from a ferromagnetic alloy having a saturation flux density of 1.6 Tesla, a coercivity of 0.2 a/m and a relative magnetic permeability of 100,000. In order to reduce the mass of the plunger 1, it may have a blind internal bore extending from the distal end thereof. However, this bore should not extend beyond line A-A shown in FIG. 1 when the plunger is in its rest position. It is also desirable that the plunger have a diameter of less than 3 mms, typically about 1 mm, and a length to diameter ratio of about 5:1. The nozzle bore in the jewel nozzle has a diameter of 300 micrometers and an l:d ratio of from 2:1 to 3:1 and the orifice at the distal end of the nozzle bore has a diameter of 300 micrometers. Ink having a viscosity of 250 cPs is fed under a pressure of 1.5 bar to an ink gallery 17 encompassing wall 13 and enters the valve head chamber via radial ports 18. When the plunger is in its rest position as shown in FIG. 1, the pad 15 is in sealing engagement with the face of the jewel nozzle 12 and thus prevents flow of ink through the nozzle orifice. In order to enhance the seal between the pad 15 and the jewel 12, we prefer to provide the proximal face of the jewel with one or more raised annular sealing ribs (not shown).

Such a valve can be operated at frequencies of from under 1 kHz to over 8 kHz to produce consistently sized droplets in the size range 150 to 1500 micrometers by controlling the length for which the current flows in the coil 3 and the frequency at which such current pulses are applied to the coil.

Figure 2:
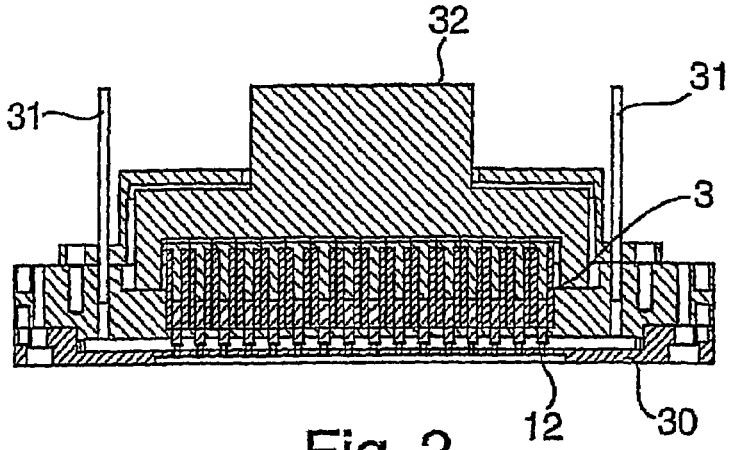
FIG. 2 is an axial cross section through a drop on demand ink jet print head incorporating an array of the valves of FIG. 1.
Figure 3:
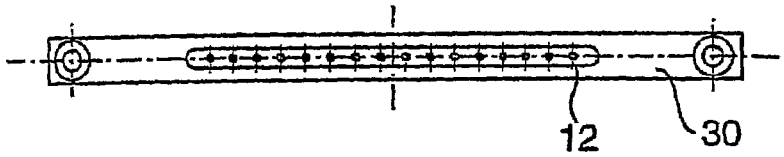
FIG. 3 is plan view of the nozzle plate of the print head of FIG. 2.

As indicated above, the valve is preferably used in an array with other valves to form a print head which extends transversely to the line of travel of a substrate upon which an image is to be printed. Such an array is shown in FIGS. 2 and 3. In this case the terminal portion 11 of the housing 10 is provided by a trough-shaped nozzle plate 30 carrying the nozzles 12 and serving as a manifold to form the ink flow gallery 17 feeding ink from ink inlet spigots 31 at each end of the nozzle plate via the inlet ports 18 to the individual valve head chambers 14 of the valves in the array. In a further alternative, the individual valve head chambers 14 are omitted so that ink from the gallery 17 flows directly into a nozzle bore when a plunger is retracted. The array is provided with a connector 32 by which individual electric current supplies can be fed to the coils 3 in each of the valves. In such an array, the housing 4 serves to reduce electrical and magnetic cross talk between adjacent valves in the array.

Figure 5:
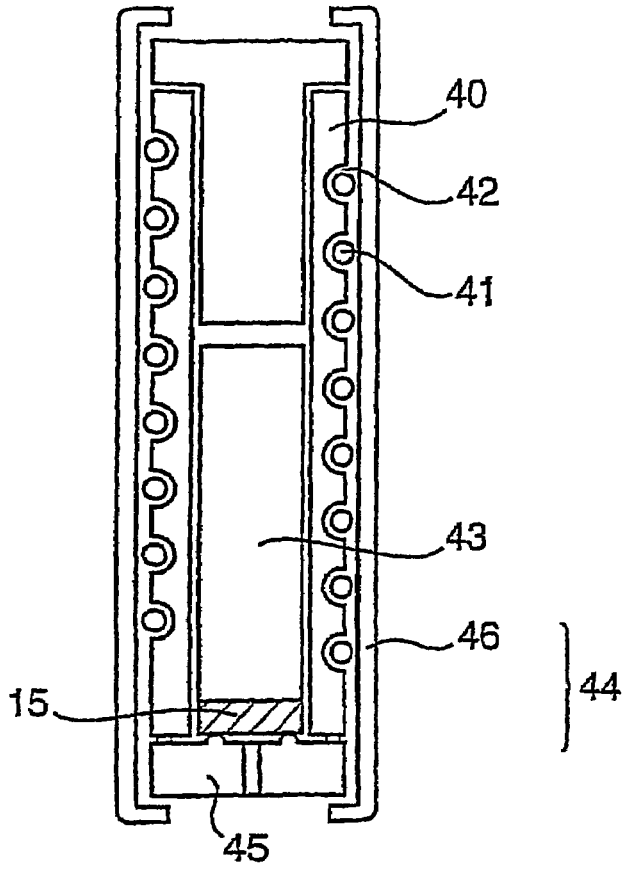
FIGS. 5 to 8 illustrate variations in the construction of the valve of FIG. 1.

Such valves and arrays can be made by machining appropriate metal components. However, one alternative form of construction is to form the tube 2 as a ceramic or silicon member 40 as shown in FIG. 5. The coil 41 can be formed in grooves 42 cut in the external surface of the tube 40 so that the air gap between the coil and the plunger 43 journalled within the tube is reduced. The coil 41 can be a wire coil wound into the grooves 42; or can be a conductive track which is deposited by any suitable means in the grooves 42. If desired, the assembly can then be coated with a polymer to retain and protect the coil within the grooves. In place of a rigid ceramic or silicon support tube, the tube 40 can be provided by a sheet of a flexible support medium, for example a suitable fibre filled polymer or the like, upon which a copper or other conductive track has been formed. The support medium is then rolled into a cylinder to form a cylindrical support carrying the coil upon its inner or outer face. In such designs, the tube 40 can extend axially to form the radial walls 44 of the valve head chamber and the distal open end of the tube closed with a jewel nozzle 45. The whole assembly can then by encased in a stainless steel or other tube 46 which acts to support the assembly and provide the magnetic return path as screening for the coil. The ends of the tube 46 can be inwardly crimped to secure the tube 40, the coil 42 and the jewel 45 in position.

Figure 6:
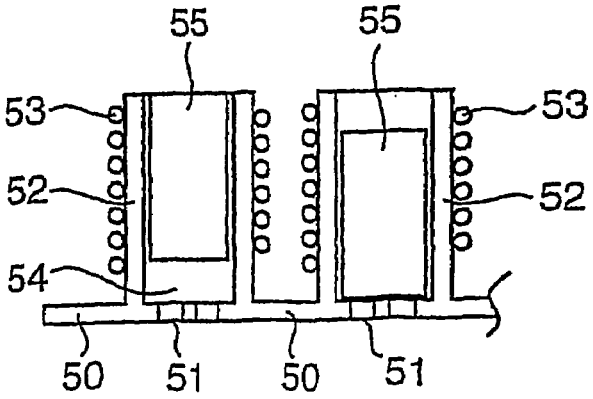

In place of the above forms of construction, an assembly of valves can be formed as shown in FIG. 6 by forming a nozzle plate 50 from a silicon or ceramic frit or other material. This plate is provided with jewel nozzles 51 at the desired spacings along the plate 50. Plate 50 is provided with upstanding tubular members 52 which form the tubes 40 of the valve design of FIG. 5. The coils 53 are wound or otherwise formed upon the upstanding tubular members 52 and the array is completed as in FIG. 5. The valve head chamber 54 is formed by the terminal distal portions of the tubular members and radial ink inlet ports may be provided to enable ink to flow into the valve head chamber. A plunger 55 is journalled in tubular members 52 for axial reciprocation under the influence of coil 53. In place of the jewel nozzle forming the closed distal end to the valve head chamber, the plate 50 can be provided as a continuously extending plate so as to form closed ends to the upstanding tubular members 52. These closed ends can then be pierced, for example by a laser, to form the bores therethrough and the nozzle orifices.

Figure 7:
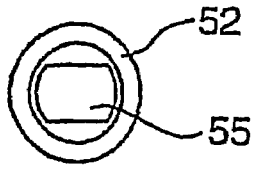

In place of the radial ink inlet ports to the valve head chamber 14 or 54, ink can flow axially past the plunger 1 or 55 from an ink inlet to the axially extending space between the tubular members 2 or 52 and the plungers 1 or 51. To form the axial passages past the plunger, the bore in tubular member 2 or 52 can have an oval or polygonal cross section and plunger 1 or 55 has a circular cross section. However, it is preferred to form plunger 1 or 55 with axial flats to it which provide axial passages between the plunger and the circular cross section bore of the tubular member as shown in FIG. 7.

Figure 8:
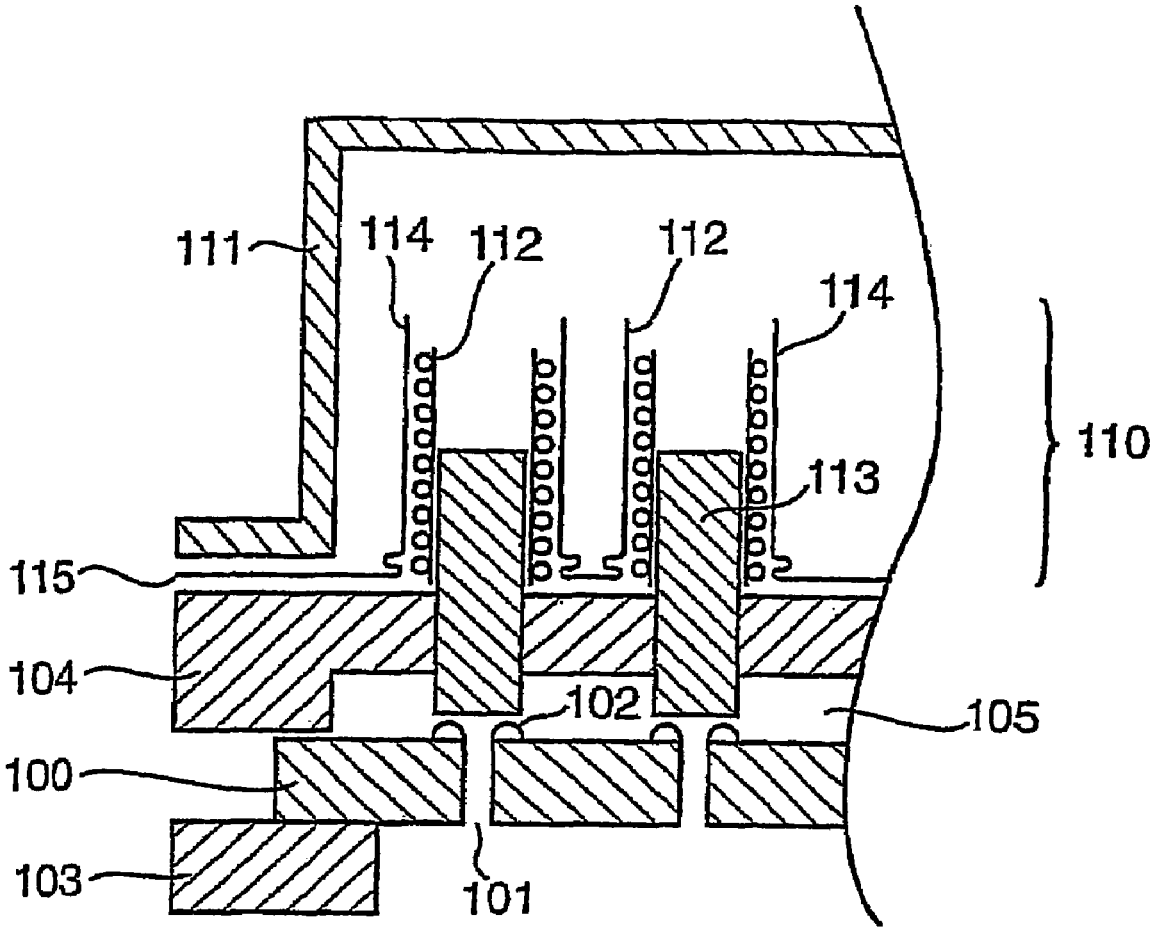

A particularly preferred form of construction of the print head is shown in FIG. 8. The nozzle plate 100 is formed with a plurality of bores 101 therethrough having a length of 1000 micrometers and a diameter of 500 micrometers. The plate is made from stainless steel and the bores are formed either by needle punches or by laser drilling each hole. Alternatively, the bores 101 can be formed by electro-etching, which technique can also be used to form the raised annular ridge 102 around the inlet to each of the bores 101. This foil nozzle plate is clamped between two stainless steel support plates 103 and 104. Plate 104 is formed with a single manifold chamber 105 which extends over all the bores 101 formed in plate 100. Alternatively, the chamber 105 can be formed in plate 100.

A valve assembly 110 contained in a support housing 111 is secured to plates 100, 103 and 104 with each of the plungers in a valve mechanism within the assembly in register with a bore 101. The valve mechanisms comprise a coil wound upon a support tube 112 within which a plunger 113 is a loose sliding fit. Each coil is surrounded by a stainless steel housing 114 which is crimped to an apertured support plate 115 clamped between housing 111 and plate 104 to locate and secure each valve mechanism with the plunger projecting through the aperture in register with a bore 101 in the nozzle plate 100. Each plunger 114 is made from a 45/55 Ni/Fe alloy sold under the trade mark Permenorm 5000 and is 2 mm in diameter and 7.5 mms long. The electrical contacts for the coils are fed from a multi-contact plug and socket from a computer controlled power source, not shown. The valve head chamber for each valve mechanism 110 is provided by the single manifold chamber 105 which is fed with ink from each end of plate 104.

As indicated above, the operation of the valve is controlled by a computer 20 in response to a CCD camera or array 21 or other sensors 22 detecting the quality of the printed dots and/or other factors such as temperature, voltage, frequency of operation of the valve which also affect the printed dot quality. Thus, the computer 20 determines which valve to open in the array of FIG. 2 and for how long so as to print a drop of the desired size at the desired position on the substrate 23 passing the print head 24. At slow frequencies of operation, for example below 1 kHz, this will usually result in a good quality dot being printed on the substrate. However, as the frequency increases, say to 2 kHz or more, the quality of the printed dot may suffer, for example due to the sudden closure of the valve causing the formation of satellite dots. The computer can respond to this by detecting from the CCD array that such satellite dots are being formed and causing the shape of the pulse of electric current applied to the coil to change so that the movement of the plunger at each extreme of its travel is reduced so as to reduce the sudden-ness of the closure of the valve by causing the plunger to soft land against the face of the jewel nozzle or end wall of the valve head chamber. Alternatively, the computer can respond to the instruction to print at high frequencies by reducing the open time of the valve by reference to a look up table 25 which carries a list of reductions in open time for a range of operating frequencies. Similarly, the software controlling the operation of the print head can detect when a valve has been idle for any length of time and provide, through another look up table, a signal to increase the open time of the valve for the initial dots printed by that valve to compensate for any drying out of the ink within the valve and/or at the nozzle orifice. In such cases, it is preferred that the information between the computer and the look up table be exchanged as bytes sized signals so that up to 256 possible permutations of open time and operating frequency can be accommodated in a single signal.

By way of comparison, when the plunger of the valve mechanism shown in FIG. 1 is made from a conventional Carpenter 430 stainless steel alloy having a saturation flux density of about 1.2 Tesla, a coercivity of about 0.95 A/m and a relative magnetic permeability of about 3,000, the valve cannot by reciprocated at frequencies greater than about 800 Hz. At current pulse frequencies for driving the coil of the valve above this, the plunger remains static within the coil and merely vibrates without significant axial movement. We believe that this is due to the failure of the material of the plunger to be able to respond rapidly enough to the pulses of current and that the plunger remains at substantially the same magnetic state between the current pulses due to the magnetic hysteresis of the material.

In a further comparison, the valve of FIG. 1 was operated with a nozzle bore having a length to diameter ratio of 10:1, 8:1, 4:1 and 0.5:1 and at a drive current frequency of 2 kHz. At the 10:1 ratio, the pressure required to feed the ink through the bore to achieve a consistent printed dot size was about 10 Bar. However, such a pressure is too high for use with conventional drop on demand print heads and would have resulted in rupture of components. If the pressure was reduced to a more acceptable level, say about 3 Bar, the rate of flow of ink through the print head was insufficient to provide ink to form the droplets consistently so that the printed dots were of uneven size and there were missing dots where the valve had not been able to acquire ink from the reservoir.

Where the ratio was 8:1, the pressure required to feed the ink to the nozzle bore to achieve uniform printed dot size and quality was 5 Bar, which is at the upper extreme of operating capability of the components of a drop on demand printer.

Where the ratio was 4:1, the printer operated successfully at an ink pressure of 1.5 to 2.5 Bar and could print consistent dots at coil drive current frequencies of from less than 1 kHz to 7 kHz.

Where the ratio was 0.5:1, the printer could not be operated, even at ink pressures of 0.1 Bar without causing spraying of the ink and the formation of multiple small dots as well as the desired main dots.

The print head of FIG. 8 was used to apply inks having a viscosity of 300 cPs through a nozzle orifice of 500 micrometers to apply different coloured inks to the pile of a neutral wool fibre coloured tufted carpet. The print head was operated at a frequency of 2 kHz to achieve substantially uniform coloration of the individual fibres within the pile. The boundaries between different colours of the printed image were clearly defined and the definition of the image was excellent. In an alternative operation, the pint head was programmed not print an ink dot at the boundary between two colours so as to minimise the risk of colour bleeding between areas of different colours.

The print heads described above with reference to the Figures are also suitable for printing applications in which colour needs to be applied to a thin fabric which does not have a backing, such as, for example, a polyester mesh. Often it is required to deposit ink on one or both sides of the fabric such that the colour on each side of the fabric is of substantially equal brilliance. Such an effect is a requirement when printing flags, for example. Most known ink jet printing machines used to print onto light textiles tend to utilize impulse jet printing technology that, whilst producing high definition printing, lays down very small amounts of ink in a dotting fashion. This tends to result in pale colours being printed unless multiple print passes are used and this significantly slows down the print rate. The other disadvantages associated with impulse jet printing technologies include the low pressures at which impulse jet printers operate and the low viscosity inks that must be used with the printers. This is a particular disadvantage for textile printing as higher viscosity inks are preferred as they provide a more consistent depth of colour pick up through the textile, which is vital to obtaining quality print. Higher viscosity fluids also prevent sideways wicking of fluid, thus avoiding poor colour definition at colour change point in the printed pattern.

In order to obtain bright colour quality and achieve a consistent depth of colour through the textile pile, it is preferred to apply the ink by opening the printing nozzle orifice and keeping it open for a period of time sufficient to form a stripe of a desired length. This technique is referred to as dosing. This process is different to producing a multiplicity of dots in a linear print fashion.

The print heads described above can be arranged to produce both dot and dosing print effects. Furthermore, the print heads can use high viscosity inks (for example 8 cp and greater) and fluid pressures of up to 3.5 bar may be used. Impulse jet heads do not have the capability for higher viscosity inks or high pressure application.

When printing on light- and medium-weight materials (when compared with the thick, piled fabrics discussed above) a nozzle size of between 80 and 250 μm is preferred. When printing on the thin meshes used for flags, 40 to 60 micron nozzle sizes have proved to be useful. The ink viscosity used for such meshes is typically 8-15 cp, and generally the viscosity of the ink is increased as the weight of the fabric increases.

The invention claimed is:

1. A method for applying an image forming composition to one or more sides of a mesh fabric using a drop on demand ink printer, comprising:

operating the drop on demand ink printer at a fluid pressure of between 1 and 3.5 bar, wherein the image forming composition has a viscosity of less than 100 cp, the drop on demand ink jet printer having an array of nozzles, each nozzle of the array of nozzles including an orifice;; and controlling the flow of the image forming composition through the nozzle orifice by the use of at least one solenoid valve, the at least one solenoid valve having a plunger, the plunger of the at least one solenoid valve having a diameter of less than 2.5 mm, the plunger journalled for axial reciprocation between a rest and an operative position within an electric coil under the influence of a magnetic field generated by that coil when an electric current passes through the coil, the distal end of the plunger extending into a valve head chamber having an outlet nozzle bore, the reciprocation of the plunger being adapted to open or close a fluid flow path from the valve head chamber through that bore, characterised in that:

a. the plunger is of a unitary construction and is made from an electromagnetically soft material having a saturation flux density greater than 1.4 Tesla, preferably abut 1.6 to 1.8 Tesla, a coercivity of less than 0.25 ampere per meter, and a relative magnetic permeability in excess of 10,000; and b. the nozzle bore leading from the valve head chamber to the nozzle orifice has a length to diameter ratio of less than 8:1, preferably from 1.5:1 to 5:1, notably from 2:1 to 4:1.

2. A method according to claim 1 wherein the viscosity of the image forming composition is in the range of 5 to 20 cp.

3. A method according to claim 1 or claim 2 wherein the nozzle orifices have a diameter in the range of 20 to 200 μm.

4. A method according to claim 3, wherein the nozzle orifices have a diameter in the range of substantially 40 to 60 gm for thin mesh fabric types.

5. A method according to claim 1, wherein the valve is held in the open position for a prolonged period of time to print continuous lines on the mesh fabric.

6. A method according to claim 5, wherein the amplitude of the current flowing through the coil required to hold the plunger in the valve open position is typically 80 to 50% less, than the current required to move the plunger initially away from its rest position.

* * * * *